United States Patent [19]

Houser, Jr.

[11] Patent Number: 4,484,452

[45] Date of Patent: Nov. 27, 1984

[54] HEAT PUMP REFRIGERANT CHARGE CONTROL SYSTEM

[75] Inventor: Marion E. Houser, Jr., Tyler, Tex.

[73] Assignee: The Trane Company, La Crosse, Wis.

[21] Appl. No.: 506,965

[22] Filed: Jun. 23, 1983

[51] Int. Cl.[3] ..... F25B 41/00; F25B 13/00

[52] U.S. Cl. ..... 62/174; 62/149; 62/160

[58] Field of Search ..... 62/174, 149, 509, 83, 62/160, 159, 277, 278, 81, 203, 204, 205, 206, 208, 209, 210, 211, 212, 222, 224, 225

[56] References Cited

U.S. PATENT DOCUMENTS

| | | | |
|---|---|---|---|
| 2,139,297 | 12/1938 | Bergdoll | 62/225 X |
| 3,237,422 | 3/1966 | Pugh | 62/149 |
| 3,264,838 | 8/1966 | Johnson | 62/149 |
| 3,324,671 | 6/1967 | Harnish | 62/149 X |
| 3,537,272 | 11/1970 | Hales et al. | 62/212 X |
| 4,136,528 | 1/1979 | Vogel et al. | 62/174 |
| 4,384,460 | 5/1983 | Vakil | 62/149 X |

*Primary Examiner*—Harry Tanner

*Attorney, Agent, or Firm*—Ronald M. Anderson; Raymond W. Campbell; Carl M. Lewis

[57] ABSTRACT

A microcomputer controlled charge control system for modulating charge in a heat pump refrigerant circuit. A charge receiver has its interior in thermal communication with the compressor suction line and has a single charge flow line connected via a charge control valve to the refrigerant circuit at a point intermediate two controllable expansion valves in the high side of the circuit. Super-heating and subcooling strategies are employed to maintain the charge level in the circuit at optimum performance levels, automatically adapting to changes in environmental load conditions on the heat pump heat exchange coils. Additional control strategy is employed to shift refrigerant charge into and out of the circuit during transient operation, such as during start-up, stop and reversal into defrost, to optimize operating efficiency during these transient conditions and also to assure correct placement of the refrigerant charge, for example, to avoid compressor slugging during start-up following an off cycle or a reversal in refrigerant flow.

15 Claims, 7 Drawing Figures

HEAT PUMP REFRIGERANT CHARGE CONTROL SYSTEM

BACKGROUND OF INVENTION

This invention relates to a novel automated system for controlling the amount of refrigerant charge in a heat pump refrigerant circuit. More specifically, it is directed to a system which varies the charge during steady state operation to maintain a desired operating characteristic for the heat pump as environmental conditions vary, and which is also adapted to add or withdraw charge from the circuit during changes in the operating state of the heat pump, to minimize adverse consequences of either excess charge or incorrectly located charge during the changes in operating state.

A heat pump for space conditioning conventionally is formed of an interconnected refrigerant circuit comprised of indoor and outdoor heat exchange coils, a refrigerant compressor, a switch-over valve to reverse the flow of refrigerant through the circuit and tubing to provide suitable interconnecting refrigerant flow lines. A first of the flow lines connects one end of each of the heat exchange coils via the compressor and switch-over valve, while the other end of each of the coils is directly interconnected by a second of the flow lines. Conventionally, two separate fluid expansion devices are included in the directly interconnecting flow line, one near each of the heat exchange coils. Typically, these expansion devices are comprised of capillary tubing, expansion valves or a combination of both, depending on the design of the particular heat pump.

It is well known in the art that, for a given heat pump design, optimum operating efficiency is achieved by matching the amount of refrigerant charge to the load encountered by the heat exchange coils. Therefore, as environmental conditions vary, it is desirable to correspondingly add or withdraw charge from the circuit to adapt the system for optimum operation based on the change in load conditions caused by the changed environmental conditions. Moreover, it is desirable that excess refrigerant liquid in the circuit be isolated during the off condition of the heat pump to prevent the charge from migrating to the compressor, and in this way, to minimize the probability of "slugging" during start-up (i.e., injecting incompressible liquid refrigerant into the compressor). Additionally, it is necessary when operating in the heating mode to periodically reverse the operation of the refrigerant circuit to defrost the outdoor coil. It is desirable to anticipate where the refrigerant liquid should be when switching occurs into and out of defrost so that the charge can be suitably located in the system to minimize defrost time and also to minimize start-stop transient losses.

Arrangements have been proposed in the past for controlling the amount of refrigerant charge in a heat pump refrigerant circuit. In general, the prior arrangements have not been satisfactory in providing overall control of refrigerant charge in a circuit in response to changing environmental conditions to achieve optimum coefficient of performance during steady state operation, while also varying refrigerant charge during transient operation to optimize seasonal performance characteristics. One example of such an arrangement is illustrated by U.S. Pat. No. 3,264,838—S. C. Johnson, issued Aug. 9, 1966, in which a charge modulation receiver for a heat pump system is connected, at one end, to the high pressure line intermediate the expansion valves and, on the other end, to the low pressure suction line leading directly to the compressor. Pressure responsive inlet and outlet valves control bleeding of refrigerant out of the refrigerant circuit from the high pressure line and control the supply of refrigerant back into the refrigerant circuit at the compressor suction line. Such an arrangement works solely on the pressure differential between the high and low sides of the refrigerant circuit and is not able to control refrigerant charge for optimum superheating or subcooling as environmental conditions vary. In essence, such an arrangement merely changes the level of refrigerant charge to one of two levels, depending on whether the heat pump system is operating in the heating or cooling cycle. It has the added disadvantage of always returning the refrigerant charge to the suction line, making the arrangement susceptible to compressor slugging unless special precautions are observed.

It is, therefore, an object of the present invention to provide a heat pump refrigerant charge control system which obviates one or more disadvantages of prior known systems.

It is another object of the invention to provide such a charge control system which is capable of maximizing system performance characteristics for different environmental conditions by optimizing the superheating of gas out of the evaporator heat exchanger, and by optimizing the subcooling of liquid out of the condenser heat exchanger.

It is another object of the invention to provide a heat pump refrigerant charge control system which improves heat pump performance and reliability by anticipating changes in the operating function of the heat pump, such as start-up or stopping, or entering/leaving a defrost cycle, to change the location of the refrigerant charge to minimize the adverse effect on performance normally caused by these transient conditions.

It is yet another object of the invention to provide a heat pump refrigerant charge control system in which refrigerant is returned to the refrigerant circuit without increasing the risk of compressor slugging on start-up.

SUMMARY OF THE INVENTION

In accordance with the invention, there is provided an improved refrigerant circuit of the type which includes indoor and outdoor heat exchange coils, a refrigerant compressor, and a switchover valve adapted to reverse the flow of refrigerant through the circuit. The refrigerant circuit of the heat pump further includes a first refrigerant flow line which interconnects one end of each of the heat exchange coils via the compressor and switchover valve, the first flow line further including suction and discharge line sections; and a second refrigerant flow line which directly interconnects the other ends of the heat exchange coils. The improvement of the invention comprises first and second controllable expansion valves included in the second refrigerant flow line, a refrigerant charge receiver with its interior in thermal communication with the suction line section, and a third refrigerant flow line having a controllable charge control valve connecting the charge receiver to the second flow line at a point intermediate the two controllable expansion valves. The improvement of the invention further comprises means for sensing refrigerant temperature and pressure at predetermined points in the refrigerant circuit and control means responsive to the sensed temperatures and pressures for controlling operation of the three valves. Bidirectional flow of refrigerant into and out of the refrigerant circuit at the intermediate point is provided, to adjust the amount of refrigerant charge in the circuit for optimizing operating conditions of the circuit.

DETAILED DESCRIPTION

Figure 1:
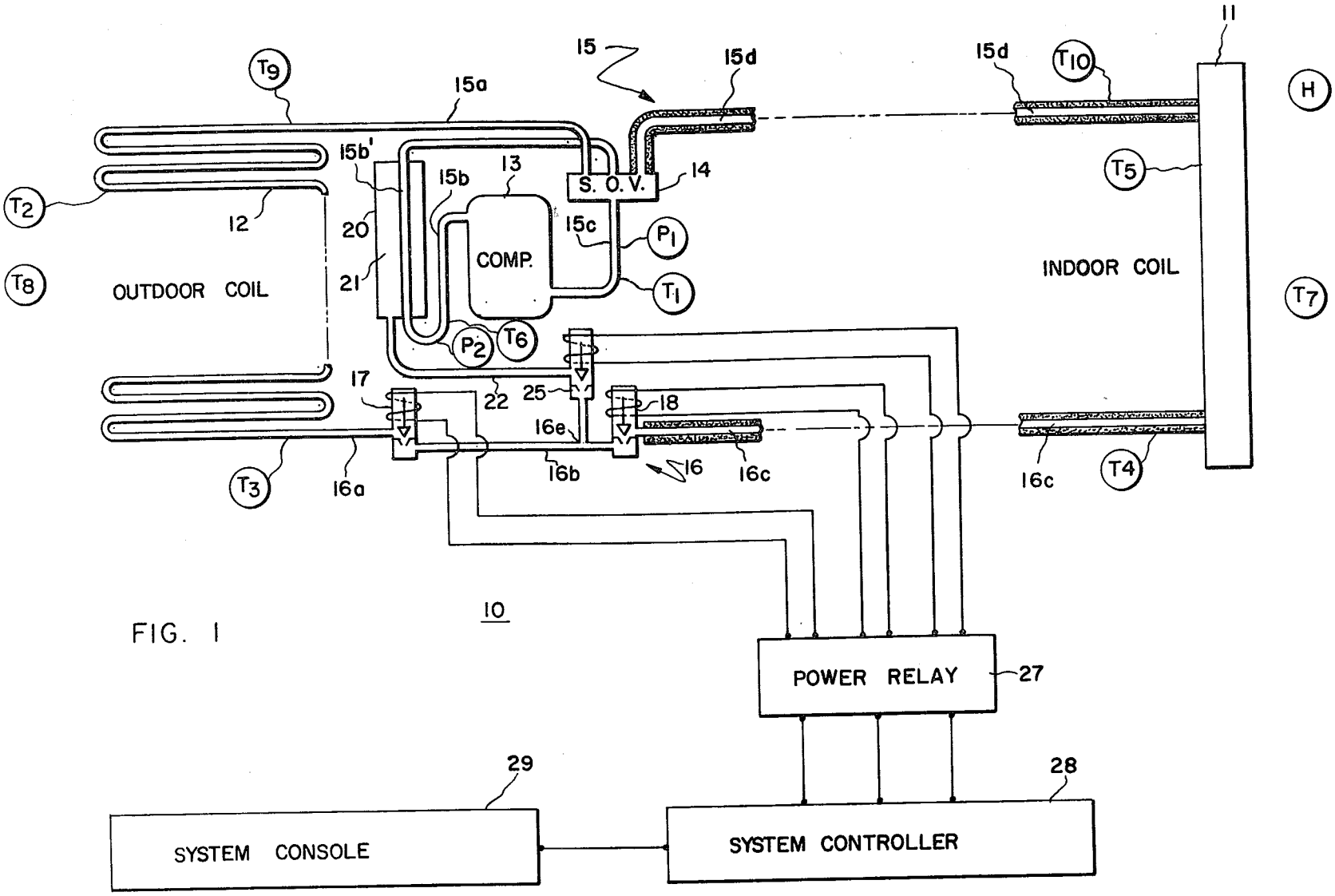
FIG. 1 is a schematic representation of a heat pump system embodying one form of the charge control system of the present invention.

Referring now to FIG. 1, there are shown the basic elements of a heat pump system 10 including the refrigerant charge control system of the present invention. Heat pump 10 includes an indoor heat exchange coil 11, an outdoor heat exchange coil 12, a refrigerant compressor 13 and a switchover valve 14 interconnected by refrigerant flow lines 15 and 16 to form a refrigerant circuit. Refrigerant flow line 15 interconnects one end of each of the indoor and outdoor coils 11, 12 and includes section **15*a* connected from the outdoor coil to one input/output port of switchover valve 14, suction line section 15*b* from the common output port of valve 14 to the input of compressor 13, a discharge section 15*c* from the output of compressor 13 to the common input port of valve 14, and finally an insulated section 15*d* leading from the other input/output port of valve 14 to one end of indoor coil 11**.

A second refrigerant flow line 16 directly interconnects the other ends of coils 11 and 12 and, as part of the refrigerant charge control system of the present invention, has included therein two controllable expansion valves (EEV) 17 and 18. Line 16 thus has a first section **16*a* leading from one end of outdoor coil 12 to expansion valve 17, a second section 16*b* intermediate the two expansion valves 17, 18 and a third section 16*c* connecting expansion valve 18 to an end of indoor coil 11. The charge control system of the invention further includes a charge receiver 20, the interior volume 21 of which is in thermal communication with portion 15*b*' of suction line 15*b*. There is further provided a third refrigerant flow line 22 connected from charge receiver 20 to a point 16*e* on flow line 16 which is intermediate expansion valves 17, 18. A controllable charge control valve (CCV) 25, which may be similar in structure to valves 17, 18, is included in third flow line 22**.

Means for sensing refrigerant temperature and pressure at various points in the refrigerant circuit includes temperature sensors $T_1$–$T_{10}$ and pressure sensors $P_1$, included in the compressor discharge line **15*c*, and $P_2$, included in the compressor suction line 15*b* preferably at a point intermediate charge receiver 20 and compressor 13. At the indoor coil 11, temperature sensor $T_4$ is positioned to sense refrigerant liquid temperature at the low end of coil 11, sensor $T_5$ is positioned to sense refrigerant temperature within coil 11 and sensor $T_{10}$ is positioned to sense refrigerant gas temperature at the top end of coil 11. Similarly, for outdoor coil 12, sensors $T_3$, $T_2$ and $T_9$ are positioned to sense refrigerant temperatures at the lower end, interior and upper end of coil 12**, respectively. In addition, temperature sensors $T_7$ and $T_8$ are provided to sense indoor ambient air and outdoor ambient air temperatures, respectively, and sensors $T_1$ and $T_6$ are provided to sense suction and discharge gas temperatures, respectively.

Control means including power relays 27, system controller 28 and system console 29 are further provided and are responsive to the sensed temperatures and pressures, as hereinafter described, to control the operation of expansion valves 17, 18, and charge control valve 25. This response and control by the control means provides bidirectional flow of refrigerant into and out of the refrigerant circuit at point **16*e* intermediate expansion valves 17, 18 to adjust the amount of refrigerant charge in the circuit in accordance with changes in operating conditions of the heat pump from time to time. System controller 28 preferably includes a microcomputer, of any well-known type, that has preprogrammed into it the necessary instructions to carry out the operative steps of the invention as will be described in greater detail in connection with the program flow charts of FIGS. 2–7. In addition, system console 29 and system controller 28 with its associated microcomputer include further input/output and control features adapted to operate and control the heat pump system through its conventional functions. For a more detailed description of console 29 and controller 28 and the manner in which they perform the operative control functions for the heat pump system 10**, reference is made to commonly assigned U.S. Pat. No. 4,328,680—Stamp et al and No. 4,333,316—Stamp et al, the disclosures of which are expressly incorporated herein by reference.

In carrying out the principles of the invention aimed at controlling the amount of refrigerant charge in the circuit, it is desirable to adopt what might be termed operating strategies for determining the level of charge needed to achieve a certain performance characteristic under varying load conditions. While the precise strategies adopted are a matter of design choice, typical strategies for superheating and subcooling are set forth herein as the basis for explanation of the invention in connection with the functional flow diagrams of FIGS. 2–7. For example, therefore, a superheat strategy might be that, for maximum evaporator performance, the degree of superheat should be controlled to be within 0°–1° F. at the coil outlet for all steady state operating conditions. It is considered more practical, however, to control the superheat to be within a range of 3°–5° F. at the evaporator outlet, and this strategy is employed in the program flow chart description. As is well known, superheat is the amount of increase in vapor temperature beyond its saturation temperature for a given pressure level, which requires the measurement of both pressure and temperature to determine. In many cases it might be impractical, particularly from a cost standpoint, to provide temperature and pressure sensors at both the heat exchange coil outlets. Consequently, evaporator outlet superheat can be indirectly determined from suction line pressure, using a single pressure sensor $P_2$, and from vapor temperatures in the suction line, using sensor $T_6$, and in the evaporator outlet, using either sensor $T_9$ or $T_{10}$ depending on whether the system is operating in the heating or cooling cycle, respectively. To achieve the 3°–5° F. specification for a given heat pump system design, by empirically determining the heat transfer and pressure drop at the switchover valve 14, plus the other line losses, a "look up" table can be established in the microcomputer memory from which the superheat existing at the evaporator outlet can be extrapolated, based on the sensed suction line pressure and temperature readings along with the temperature reading at the evaporator outlet.

An example of a subcooling strategy might be that for optimum condenser heat exchange performance, subcool temperature, i.e., the reduction in liquid temperature at the condenser outlet beyond the liquid saturation temperature for the pressure at that point, should be 1°–3° F. or, for practical reasons, 2°–5° F. during steady state operating conditions. As in the case of superheat, while subcooling can be determined from sensed pressure and temperature at the corresponding coil outlet, it may be more practical, particularly from a cost standpoint, to use sensed temperature at the coil outlet, sensor $T_4$ or $T_3$ as appropriate, and sensed pressure $P_1$ at the compressor discharge line 15*c*, coupled with suitable compensation for losses incurred in the switchover valve and interconnecting lines.

Before turning to a consideration of the program flow charts of FIGS. 2–7 for a detailed description of the operation of the invention, it may be helpful to review the general principles of operation with reference to FIG. 1. Charge receiver 20 serves as a storage vehicle for excess refrigerant and has passing through it a length 15*b*′ of suction line 15*b* which serves as a heat exchanger with the interior volume 21 of receiver 20. A smaller flow line 22 connects the bottom of receiver 20 with the refrigerant circuit at point 16*e* intermediate the expansion valves 17 and 18 via a charge control valve 25. When valve 25 is opened, refrigerant charge is added to or removed from the refrigerant circuit via flow line 22, depending on the pressure of the refrigerant in the circuit at point 16*e* and the temperature of the suction line gases flowing through suction line section 15*b*′. Valve 17 serves as the expansion valve for outdoor coil 12 when the heat pump is in the heat cycle and the outdoor coil is acting as the evaporator. Similarly, valve 18 serves as the expansion valve for indoor coil 11 which acts as the evaporator when the heat pump is in the cooling cycle. Valves 17 and 18 preferably are known types of electrically controlled expansion valves, which are controllable from system controller 28 to establish desired superheat values as determined by the superheat strategy such as described above.

Modifying the amount of charge in the refrigerant circuit while the system is in steady state operation occurs in the following manner. For this purpose, it will be assumed that the heat pump is operating in the cooling cycle, with EEV valve 17 open and EEV valve 18 being modulated to control superheat at the outlet of indoor coil 11 in known manner. The charge control valve 25 is closed. To increase the circulating charge in the circuit, system controller 28 acts to close EEV valve 17 and to open EEV valve 18 to raise the superheat in the compressor suction line 15*b* to a value of, for example, between 30° F. and 40° F. as determined from sensors $P_2$ and $T_6$. At this time, charge control valve 25 is opened until head pressure of the system increases by a predetermined amount, such as 20 PSI, as determined from sensor $P_1$. Valve 17 is then opened, and valve 18 resumes its modulating function to maintain superheat at the desired level in accordance with the aforementioned superheat strategy. If necessary, this process is repeated if subcooling for the system is still below the proper value as determined by the aforementioned subcooling strategy. To reduce circulating charge, the charge control valve 25 is modulated open and closed with EEV valves 17 and 18 maintained in their normal operating condition. The same description applies to operation of the heat pump in the heating cycle except that the roles of EEV valves 17 and 18 are reversed from that just described. Thus, by varying the amount of circulating refrigerant as just described, and by controlling the position of either valve 17 (in heating) or valve 18 (in cooling), the superheat and subcooling are controlled, and the system capacity is varied correspondingly, thereby matching the system capacity with that required for the particular environmental conditions encountered.

When the compressor is shut down, it is important to prevent migration of refrigerant to the compressor 13 during the off period to avoid "slugging" of the compressor at start-up. This is accomplished by opening charge control valve 25 under control of system controller 28 just prior to shut down. Opening valve 25 results in charge receiver 20 being filled with high pressure liquid refrigerant. When the compressor 13 is stopped, system controller 28 causes the three valves 17, 18 and 25 to close, isolating the major part of the liquid refrigerant within charge receiver 20 and preventing liquid refrigerant from migrating to compressor 13.

The following described pre-start-up sequence is employed in order to equalize differential pressures across compressor 13 at start-up and to minimize start-up losses. At some predetermined time prior to start-up, such as ten seconds, EEV valves 17 and 18 are opened. As start-up commences, and assuming the heat pump is in the cooling cycle, EEV valve 17 is closed, charge control valve 25 and EEV valve 18 are opened, and compressor 13 is then started. Valve 18 is modulated to control superheat. Valve 17 remains closed until the head pressure equivalent condensing temperature exceeds the equivalent temperature $T_8$ of the air entering the outdoor condenser coil 12 by a predetermined value, such as 30° F., at which time EEV valve 17 is opened and charge control valve 25 is closed. The charge modulation operation described above then takes over to optimize system performance. When operating in the heating cycle, the same start-up sequence is followed except for interchanging of the functions of EEV valves 27 and 18.

When the heat pump is operating in the heating cycle, it is necessary to defrost the outdoor coil periodically by reversing the flow of refrigerant for a period of time sufficient to cause the temperature at the outlet of the outdoor coil to reach a predetermined temperature, such as 50°–55° F., which indicates that all ice on the coil has been melted. It is known that, for a given heat pump system, the optimum amount of refrigerant circulating in the circuit during heating cycle operation is less than the optimum amount of refrigerant circulating during cooling cycle operation. It is desirable, therefore, to increase the system capacity during the defrost cycle by increasing the charge in the system, in order to minimize the time in defrost with a consequent improvement in overall system efficiency. To this end, just prior to defrost initiation, the charge control valve 25 is opened to allow the high pressure liquid from indoor coil 11 to enter the charge receiver 20 for temporary storage with consequent reduction in head pressure $P_1$. Upon initiation of defrost, te differential pressure across switchover valve 14 has been reduced, and the excess liquid that would have been in the indoor coil 11 is not available to enter compressor 13 directly. Upon entry into the defrost cycle, EEV valve 17 is closed and valves 25 and 18 are opened, thus introducing all of the refrigerant stored within receiver 20 into the starved indoor evaporator coil 11. This condition continues until EEV valve 18 begins to modulate to control superheat out of the indoor coil as described above. When head pressure $P_1$ reaches a predetermined level, such as 225 PSI, charge control valve 25 is closed and EEV valve 17 is opened, and the normal defrost cycle continues until the aforementioned 50°–55° F. liquid temperature is sensed by sensor $T_3$ at the outlet of outdoor coil 12. Just prior to termination of the defrost cycle, charge control valve 25 is opened with consequent lowering of heat pressure $P_1$ as refrigerant is stored in receiver 20. Upon reaching a head pressure of, for example, $P_2+60$ PSIG, valve 25 is closed. Switchover valve 14 is then operated, and the outdoor fan is turned on to return the system to the heating cycle, at which time valve 18 is closed and valve 25 is opened to return refrigerant charge to the circuit. When head pressure $P_1$ reaches an equivalent condensing temperature of 20° F. above the temperature of air entering the indoor condenser coil 11, the charge control valve 25 is closed and valve 18 is opened. EEV valve 17 is then modulated to maintain superheat at the proper level, and the charge control operation described above continues to optimize steady state system performance.

Figure 2:
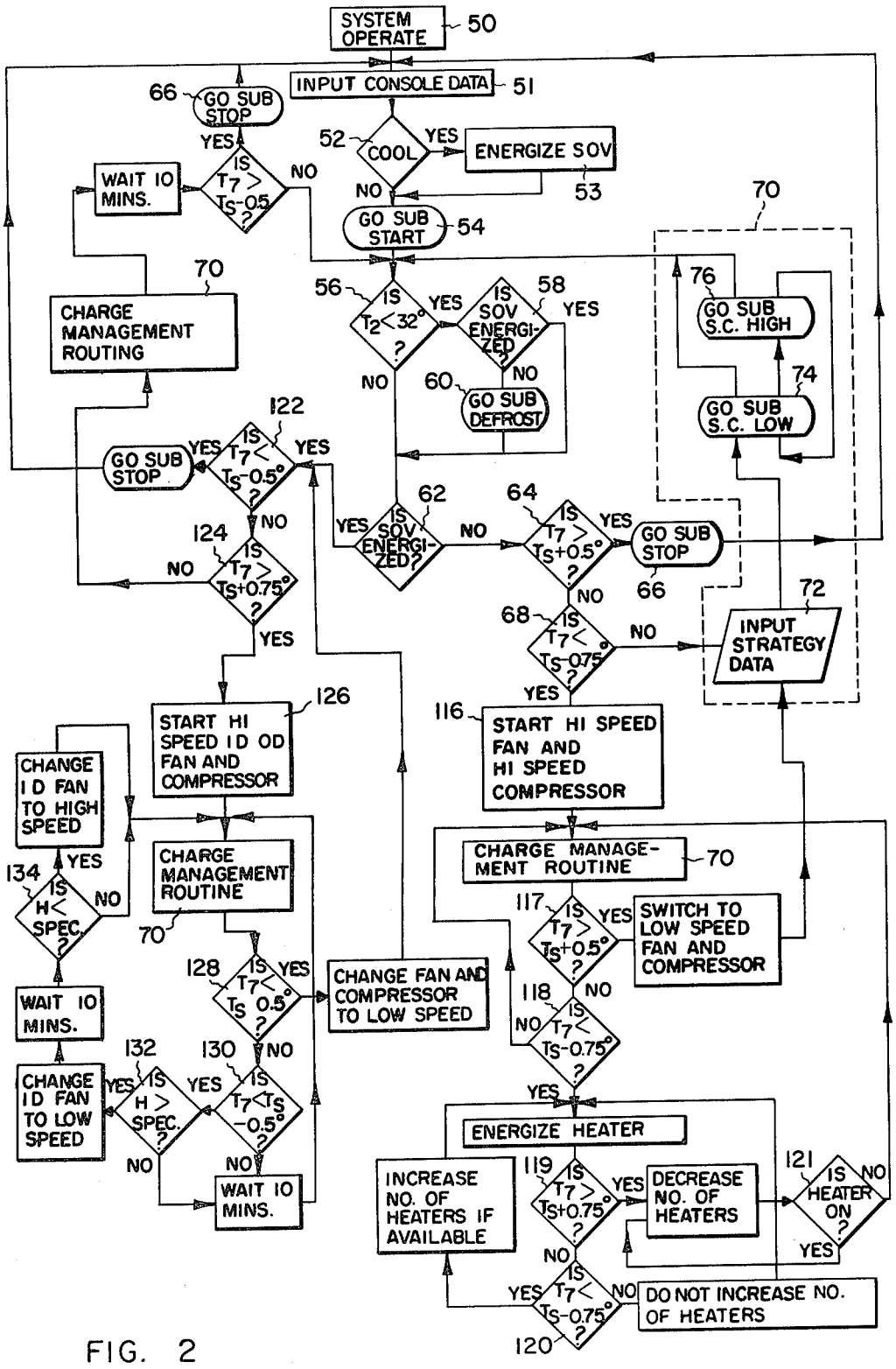
FIGS. 2–7 are program flow charts illustrating the manner in which certain program routines may be established in a microcomputer included in the system of FIG. 1 to carry out the various operations of the present invention.

Referring now to FIG. 2, there will be considered an example of a program flow chart which indicates the manner in which the microcomputer of system controller 28 may be programmed to operate the heat pump system of FIG. 1 in accordance with the principles of the present invention. It will be understood that only that portion of the program flow chart relevant to the invention is illustrated, and that other aspects of the overall system program have been omitted as being unnecessary to an understanding of the invention. Thus, upon initiation of operation of the heat pump, the program enters system operate block 50, and instruction 51 causes the data available from system console 29 to be entered into memory. Enquiry 52 determines if the system is in the cool mode and, if so, instruction 53 energizes the switchover valve 14. The "start" subroutine 54 is then entered and is functionally operative in a manner to be described in connection with FIG. 3. After completion of the start subroutine 54, enquiry 56 determines if the outdoor coil temperature $T_2$ is below 32° F. If yes, enquiry 58 determines if the switchover valve 14 is energized for the purpose of determining if the heat pump is in the heat cycle since this low temperature coil condition would require entry into the defrost cycle subroutine as indicated at block 60 and described subsequently in connection with FIG. 7. If coil 12 is above 32° F., enquiry 62 similarly determines if the system is in the heat or cool cycle, the switchover valve being energized in the cool and defrost cycles only.

If the heat pump is in the heating cycle, the program moves to enquiry 64 to determine if the indoor temperature $T_7$ is sufficiently above the room set point temperature $T_S$ to warrant no further operation and, if so, the program moves into the "stop" subroutine 66, described below, at the conclusion of which the program returns to system operation instruction 50. If, on the other hand, the indoor temperature is low enough to require continued operation in the heat cycle, enquiry 68 determines if indoor temperature $T_7$ is within the desired comfort range. Assuming it is, the program enters that portion of the program which may be referred to as the charge management routine 70.

Charge management routine 70 is the functional procedure which maintains superheating and subcooling at desired levels during steady state operation of the heat pump for optimum performance in accordance with the particular selected strategy criteria. The routine is entered at various stages of the operational program. For simplification in the drawings, the routine is generally indicated by the rectangle identified with numeral 70, and for completeness of disclosure is shown in flow chart detail by the box defined by dashed lines in FIG. 2 and also identified by numeral 70. Upon entering the charge management routine the program moves to instruction 72 which inputs the stored superheat and subcool strategy criteria such as has been previously described. After inputting the strategy data, the program moves to S.C. LOW subroutine 74 following which it either enters S.C. HIGH subroutine 76 or goes back to the main program. As will be seen, exiting from S.C. HIGH subroutine 76 can be eitherback through S.C. LOW subroutine 74 or directly back to the main program.

Figure 5:
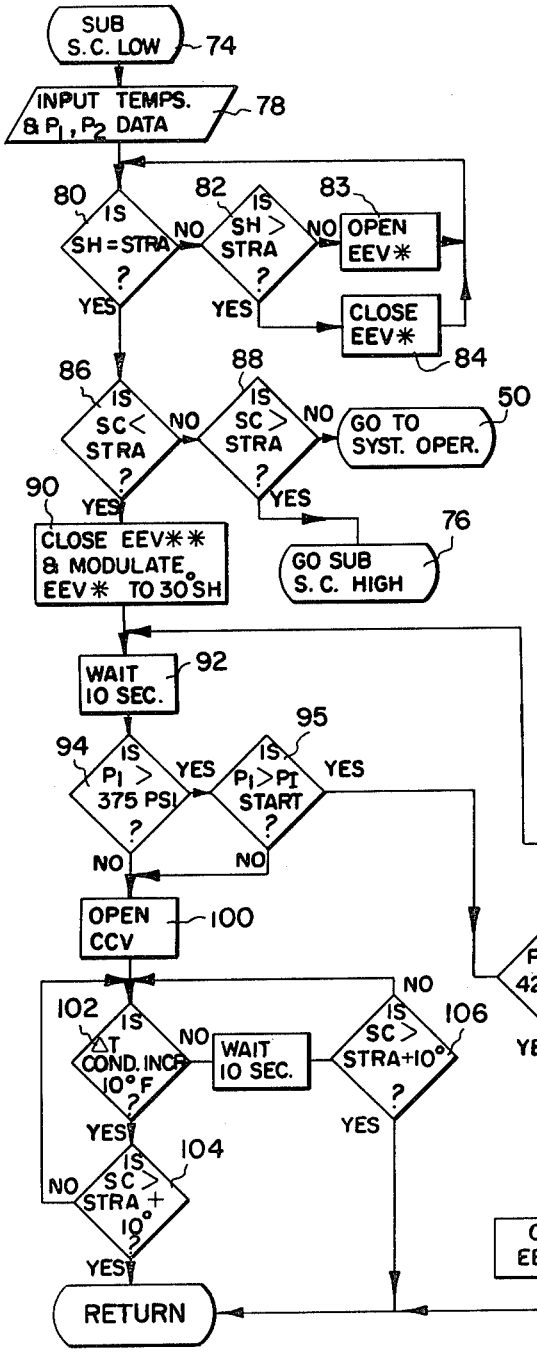
Figure 6:
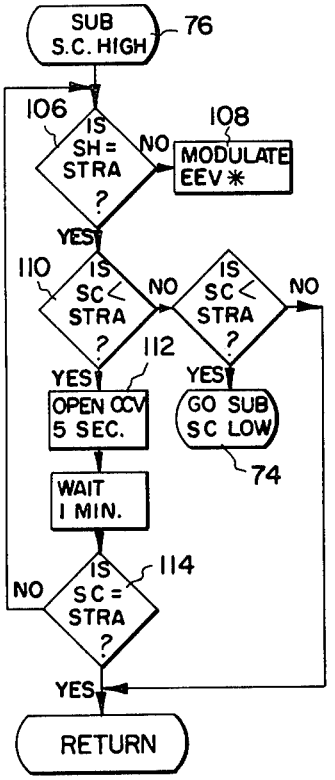

Referring now to FIG. 5, entry into S.C. LOW subroutine 74 begins with instruction 78 inputting the sensed coil inlet and outlet temperature data and the discharge and suction pressures $P_1$ and $P_2$. After this, enquiry 80 determines from $T_9$ and $P_2$ if superheat is equal to the strategy value from input instruction 72 and, if not, enquiry 82 determines if superheat is greater than the strategy value and instructions 83, 84 cause suitable modulation of, in this case, valve 17 until the strategy value is achieved. In the flow charts, the designation EEV* refers to the valve 17 or 18 when it operates as the modulation expansion valve, while EEV refers to the remaining valve as appropriate. The designation CCV always refers to valve 25. Once the strategy value for superheat is achieved, enquiry 86 determines if subcool is below the strategy value and, if not, enquiry 88 causes the subroutine to return to system operate 50 or to move into S.C. HIGH subroutine 76** depending on whether subcool is equal to or higher than strategy.

Assuming subcool is below strategy value, instruction 90 closes valve 18, in the heat cycle, and modulates valve 17 until a 30° F. superheat is achieved. After a wait of ten seconds, enquiries 94–98 successively determine if an exceedingly high head pressure $P_1$ exists, resulting in opening of the valve 18 and subsequent return to system operate 50. Assuming, however, that head pressure $P_1$ is satisfactorily below a suitable level, such as 375 PSI, instruction 100 operates to cause charge control valve 25 to be opened until enquiries 102, 104 and 106 determine that the temperature differential across indoor condenser coil 11 has increased by, for example, 10° F. or that after a predetermined waiting period, such as ten seconds, the value exceeds the strategy value by an incremental amount, such as 10° F., after which, in either case, the subroutine is returned to the main program point.

Upon the next pass through the S.C. LOW subroutine 74, it would be determined in enquiry 88 that subcool exceeds strategy which would then result in moving to S.C. HIGH subroutine 76 shown in FIG. 6. Enquiry 106 and instruction 108 modulate valve 17 to achieve proper superheat value as shown by blocks 80 and 82–84 of FIG. 5. Excess subcool determined in enquiry 110 results in instruction 112 causing charge control valve 25 to be opened a predetermined time, such as five seconds, to inject charge into the circuit, after which enquiry 114 determines if the process should be repeated or if proper subcool has been achieved for return to the main program. From the foregoing, it can be seen that the procedure involves first establishing superheat to the proper strategy level after which subcool is adjusted to the desired level.

Reverting to FIG. 2, it will be seen that the charge management subroutine just described is included in the main operating program at points following a change in operating state of the heat pump as well as when the system is operating within the comfort range. Thus, if it is determined by enquiry 68 that the room temperature $T_7$ is below the comfort level which generates an instruction 116 to fan speed and compressor speed, assuming the heat pump is a dual compressor speed system, the program re-enters charge management subroutine 70 for the purpose of adjusting the charge in the refrigerant circuit to conform to the new operating conditions of the heat pump. The responses to additional enquiries 117, 118, 119, 120, and 121, which may or may not lead to increases or decreases in the number of active heaters and other state changes, can also lead to entry into charge management subroutine 70 as shown. As previously described, charge management is accomplished by first modulating expansion valve 17 to achieve proper superheat, e.g., 3°–5° F. at the outlet of outdoor coil 12, following which valve 18 and charge control valve 25 are operated as needed to modify the charge in the refrigerant circuit to adjust subcool to the desired strategy level, e.g., 2°–5° F., at the outlet of indoor condenser coil 11.

Similarly, when the switchover valve 14 is energized and the heat pump is operating in the cooling cycle, charge management subroutine 70 is employed while the system is operating and room temperature is within the comfort range, as determined by enquiries 122 and 124. It is also employed following a change in operating state, as at instruction 126 calling for extra cooling capacity, or following a reduction in the operating state to lower cooling capacity as determined by enquiries 128, 130, 132. It may be noted in passing that enquiries 132 and 134 have provisions for determination of room humidity level from a room humidity sensor in determining whether to reduce the operation state of the heat pump to a lower capacity level.

Figure 3:
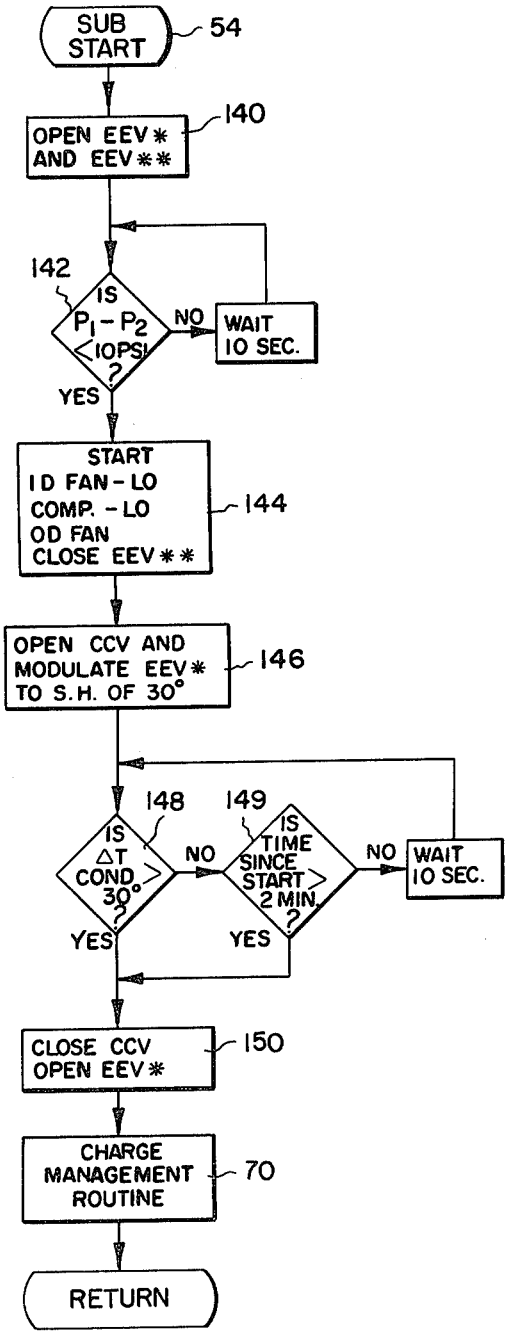

Referring now to FIG. 3, the start subroutine 54 is entered by instruction 140 which opens both valves 17 and 18 to equalize the pressure differential across compressor 13 and reduce stress on the compressor at start-up. When enquiry 142 determines that the pressure differential $P_1$–$P_2$ is below a suitable value, such as 10 PSI, instruction 144 starts compressor operation and closes either valve 18 or valve 17 depending on whether the heat pump is in the heating or cooling cycle, respectively. Following this, instruction 146 opens charge control valve 25 to inject charge into the circuit and modulates the expansion valve 17 or 18, as appropriate, until superheat of 30° F. is achieved. When enquiry 148 determines that the differential temperature across the condenser coil has reached 30° F. or, if not, when enquiry 149 determines that more than two minutes have elapsed since start commenced, instruction 150 closes charge control valve 25 and opens the appropriate expansion valve 17 or 18. Once this is done, the program enters the aforedescribed charge management routine 70 to stabilize operation of the heat pump at its desired performance level as determined by the selected set of strategy values for superheating and subcooling.

Figure 4:
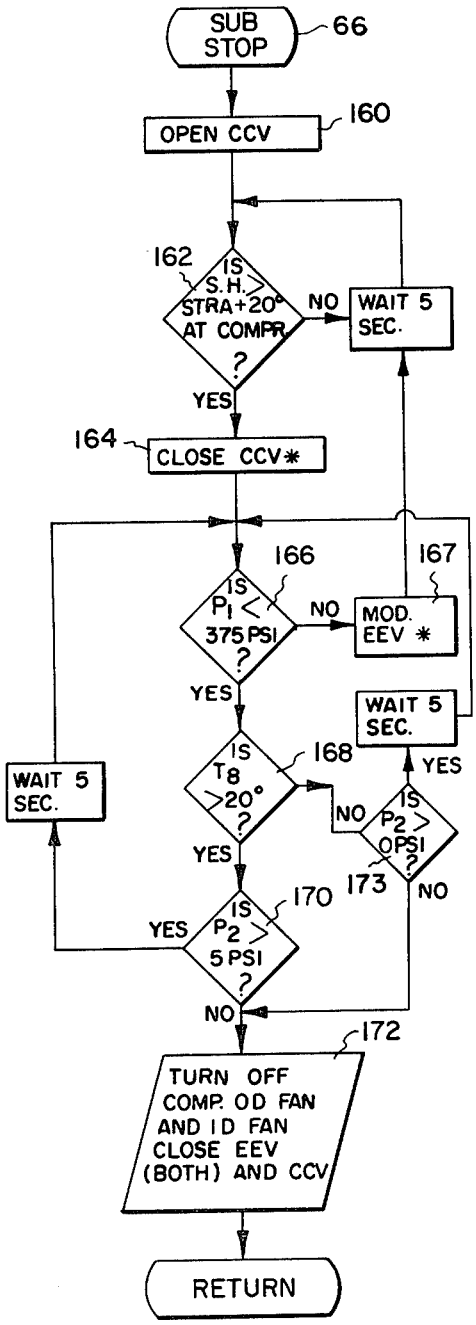

In FIG. 4, the stop subroutine 66 is initiated by instruction 160 which opens the charge control valve 25 to allow circlating charge to enter and be stored within charge receiver 20. When enquiry 162 determines that superheat has risen above the strategy level by 20° F. at the compressor, instruction 164 closes the appropriate EEV valve, thus forcing the majority of the refrigerant charge into receiver 20. Enquiry 166 monitors head pressure $P_1$ and instruction 167 modulates the appropriate expansion valve until head pressure is reduced below a suitable value, such as 375 PSI. Following this, enquiry 168 determines if outdoor temperature $T_8$ is above 20° F. and, if not, enquiry 173 determines when suction pressure $P_2$ is below 0 PSI or, if outdoor temperature $T_8$ is above 20° F., then enquiry 170 determines if suction pressure $P_2$ is below 5 PSI. When these conditions are reached, instruction 172 turns the compressor off and closes charge control valve 25 and both valves 17 and 18** thus isolating the charge and preventing it from migrating to the compressor during the off cycle.

Figure 7:
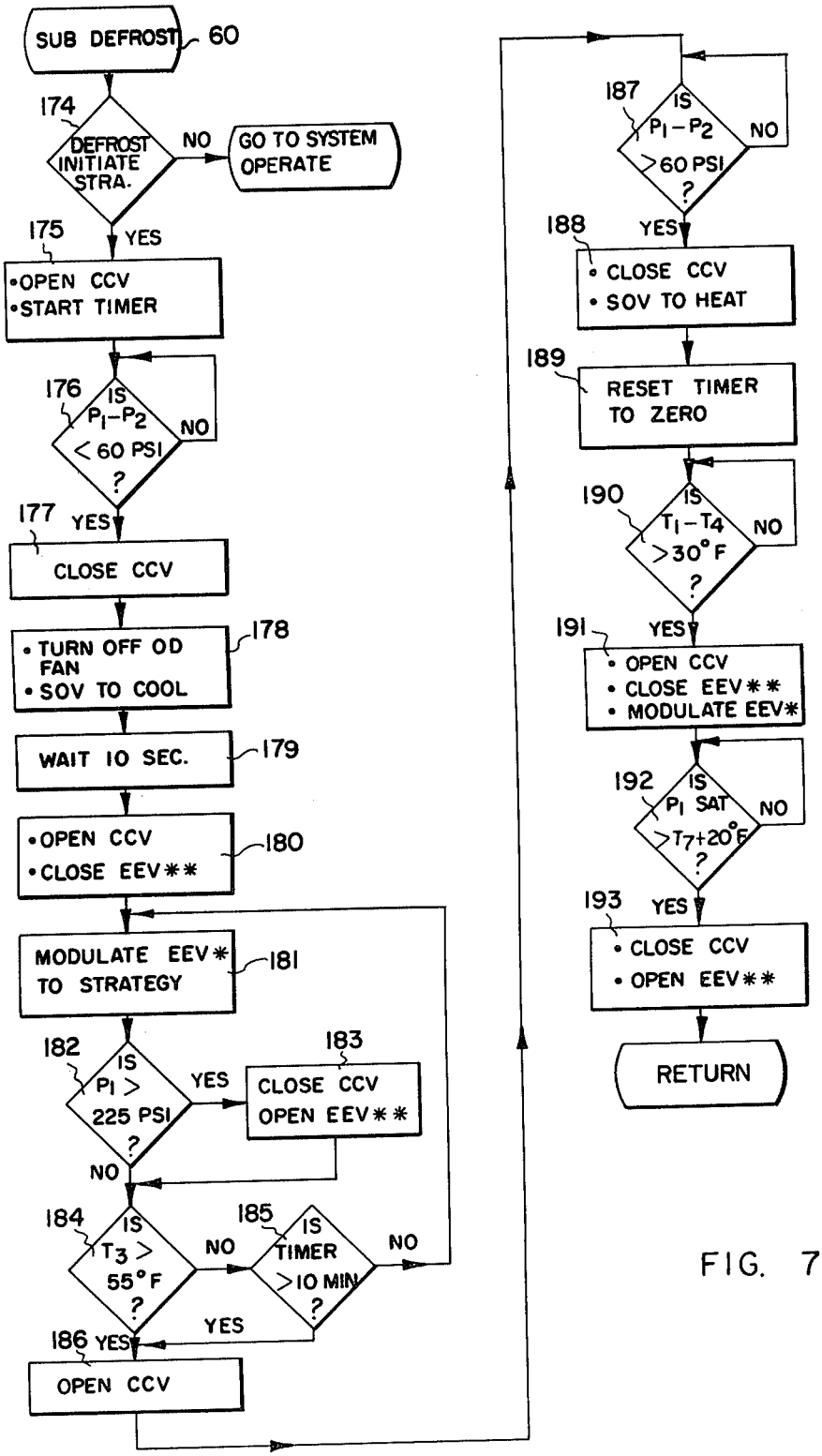

In FIG. 7, the defrost routine 60 is initiated as instruction 174 by determining that the defrost initiate stragety is met. There are many accepted ways to determine that defrosting of the outdoor coil is required and reference may be had to the aforementioned commonly assigned patents for representative examples thereof. When enquiry 174 determines defrost is necessary, instruction 175 opens the CCV valve 25 and initiates a timer in the microprocessor to ensure that no defrost cycle exceeds ten minutes. With valve 25 open, refrigerant charge enters volume 21 of charge receiver 20. When compressor 13 differential pressure $P_1$–$P_2$ is decreased to less than 60 PSI, instruction 177 closes the CCV valve 25. Instruction 178 reverses the refrigerant flow by switching the switchover valve 14 and turning off the outdoor fan. Instruction 179 provides ten seconds for the switchover valve 14 to change position. Instruction 180 opens CCV valve 25 and closes EEV valve 17 to allow refrigerant to return to system 10 from the charge receiver 20. Instruction 181 actuates EEV valve 18 to control refrigerant flow in accordance with the particular defrost superheat strategy. Enquiry 182 determines when enough charge is added to the system by limiting the discharge pressure $P_1$ to 225 PSIG. Instruction 183 opens EEV valve 17 and closes CCV valve 25 to allow a normal defrost operation. Enquiry 184 determines when refrigerant in line **16*a* temperature $T_3$ exceeds 55° F., and enquiry 185 determines when time in defrost exceeds ten minutes. When $T_3$ exceeds 55° F., or when the elapsed time of defrost exceeds ten minutes, instruction 186 opens CCV valve 25, removing refrigerant from the refrigerant circuit of system 10, thus decreasing pressure difference $P_1$–$P_2$ across compressor 13. Enquiry 187 limits this pressure difference to not exceed 60 PSI. Instruction 188 initiates defrost termination by switching the switchover valve 14 to the normal heating position and closing CCV valve 25 to stop refrigerant charge removal. Instruction 189 resets the timer for the next defrost cycle. Enquiry 190 establishes that switchover valve 14 is in the correct position and the system is in the heating cycle. Instruction 191 begins to recharge system 10 by opening CCV valve 25 and closing EEV valve 18 while EEV valve 17 in modulated to strategy 72. Enquiry 192 establishes when adequate charge has been added to system 10 to implement instruction 193 which closes CCV valve 25 and opens EEV valve 18. At this point, the microprocessor of system controller 28** is returned to the system operate program for normal heating mode operation.

From the foregoing, it will be appreciated that there has been described an improved system for managing charge in a heat pump refrigerant circuit to achieve optimum performance as determined by preset strategy criteria. Further, the system improves energy efficiency by controlling the amount and location of charge distribution in the circuit to reduce transient losses and to reduce defrost cycle time.

In accordance with the patent statutes, there has been described what at present is considered to be a preferred embodiment of the invention. However, it will be obvious to those skilled in the art that various changes and modifications may be mde therein without departing from the invention. It is, therefore, intended by the appended claims to cover all such changes and modifications as fall within the true spirit and scope of the invention.

I claim:

1. An improved refrigerant charge control system for a heat pump used to temperature condition an indoor zone under variable load conditions, said heat pump having a refrigerant circuit including indoor and outdoor heat exchange coils, a refrigerant compressor, and a switchover valve adapted to reverse the flow of refrigerant through the refrigerant circuit so that the heat pump may be selectively operated in either a heating mode or a cooling mode; the circuit further including a first refrigerant flow line interconnecting one end of each of the heat exchange coils via the compressor and the switchover valve, the first flow line having suction and discharge line sections, and a second refrigerant flow line directly interconnecting the other ends of the heat exchange coils, the improvement comprising:

first and second controllable expansion valves in the second refrigerant flow line;

a refrigerant charge receiver, the interior of which is in thermal communication with said suction line section;

a third refrigerant flow line including a controllable charge control valve connecting said charge receiver to the second refrigerant line at a point intermediate said first and second controllable expansion valves;

means for sensing refrigerant temperature and pressure at predetermined points in the refrigerant circuit;

and control means responsive to said sensed temperatures and pressures for controlling operation of said valves to provide bidirectonal flow of refrigerant into and out of the refrigerant circuit at said intermediate point to adjust the amount of refrigerant charge in the refrigerant circuit for efficient operation of the system in each of the heating and cooling modes, as the temperature conditioning load on the heat pump changes.

2. The control system of claim 1 in which said sensing means includes a pressure sensor in at least one of the suction and discharge line sections and a temperature sensor at the outlet of at least one of the heat exchange coils; and said control means includes means for determining, from said pressure sensor and said temperature sensor, superheat temperature of the refrigerant vapor at the outlet of the respective heat exchange coil.

3. The control system of claim 1 in which said sensing means includes a pressure sensor in each of the suction and discharge line sections and a temperature sensor at each end of both heat exchange coils; and the control means includes means for determining, from said pressure and temperature sensors, the superheat temperature of refrigerant vapor at the outlet of the heat exchange coil operating as an evaporator and the subcool temperature of the refrigerant liquid at the outlet of the heat exchange coil operating as a condenser, and for controlling the operation of said valves in response to the determind superheat and subcool temperatures.

4. The control system of claim 3 in which said control means includes means operative at shutdown of the compressor for isolating the majority of refrigerant charge in said charge receiver during an off cycle by initiating the charge control valve just prior to shutdown to transfer refrigerant charge from the circuit into the receiver, and by closing at least the charge control valve after shutdown to hold the stored charge out of the circuit.

5. The control system of claim 4 in which said control means further includes means for closing said first and second controllable expansion valves after shutdown to minimize migration of any remaining refrigerant charge in the circuit to the compressor during the off cycle.

6. The control system of claim 5 in which said control means includes means operative during compressor start-up for opening both expansion valves just prior to start-up to minimize pressure differential across the compressor and, upon start-up of the compressor, for closing the controllable expansion valve nearest the heat exchange coil serving as the condenser and opening the charge control valve to inject refrigerant into the circuit.

7. The control system of claim 6 in which said control means includes means, effective upon the heat pump entering a defrost cycle, initially for withdrawing refrigerant charge from the circuit until the switchover valve is actuated to reverse the refrigerant flow in the circuit and for adding refrigerant charge back to the circuit after the flow is reversed, to achieve a desired system capacity level whereby adverse pressure transients across the compressor are minimized, increased assurance of switching of the switchover valve is realized by maintaining minimal pressure difference across the switchover valve and large surges of refrigerant liquid into the compressor at the time the system is reversed for defrost are effectively eliminated.

8. The control system of claim 1 in which said control means includes means operative at shutdown of the compressor for isolating the majority of refrigerant charge in said charge receiver during an off cycle by initiating the charge control valve just prior to shutdown to transfer refrigerant charge from the circuit into the receiver, and by closing at least the charge control valve after shutdown to hold the stored charge out of the circuit.

9. The control system of claim 8 in which said control means further includes means for closing said first and second controllable expansion valves after shutdown to minimize migration of any remaining refrigerant charge in the circuit to the compressor during the off cycle.

10. The control system of claim 1 in which said control means includes means operative during compressor start-up for opening both expansion valves just prior to start-up to minimize pressure differential across the compressor and, upon start-up of the compressor, for closing the controllable expansion valve nearest the heat exchange coil serving as the condenser and opening the charge control valve to inject refrigerant into the circuit.

11. The control system of claim 1 in which said control means includes means, effective upon the heat pump entering a defrost cycle, initially for withdrawing refrigerant charge from the circuit until the switchover valve is actuated to reverse the refrigerant flow in the circuit and for adding refrigerant charge back to the circuit after the flow is reversed, to achieve a desired system capacity level whereby adverse pressure transients across the compressor are minimized, increased assurance of switching of the switchover valve is realized by maintaining minimal pressure difference across the switchover valve and large surges of refrigerant liquid into the compressor at the time the system is reversed for defrost are effectively eliminated.

12. An improved refrigerant charge control system for a heat pump used to temperature condition an indoor zone under the variable load conditions, said heat pump having a refrigerant circuit including indoor and outdoor heat exchange coils, a refrigerant compressor, and a switchover valve adapted to reverse the flow of refrigerant through the refrigerant circuit so that the heat pump may be selectively operated in either a heating mode or a cooling mode; the circuit furter including a first refrigerant flow line interconnecting one end of each of the heat exchange coils via the compressor and the switchover valve, the first flow line having suction and discharge line sections, and a second refrigerant flow line directly interconnecting the other ends of the heat exchange coils, said control system comprising:

first and second electrically modulated expansion valves disposed in the second refrigerant flow;

a refrigerant charge receiver, the interior of which isin thermal communication with said suction line section;

a third refrigerant flow line including an electrically controlled valve connecting said charge receiver to the second refrigerant line at a point intermediate said first and second electrically modulated expansion valves;

means for determining superheat at the suction line section of the refrigerant circuit; means for determining subcooling at the second refrigerant flow line of the refrigerant circuit; and control means for controlling operation of the first and second electrically modulated expansion valves and the electrical controlled valve in the third refrigerant flow line to adjust the proportion of refrigerant charge stored in the charge receiver and flowing in the refrigerant circuit to achieve predetermined levels of superheat and subcooling during operation of the heat pump in both the heating and cooling modes as the temperatures conditioning load changes.

13. The control system of claim 12 wherein the means for determining superheat and the means for determining subcooling both include means for sensing refrigerant pressure and refrigerant temperature at predefined points in the refrigerant circuit.

14. The control system of claim 13 wherein the means for sensing refrigerant pressure include pressure sensors disposed in both the suction and discharge line sections of the refrigerant circuit.

15. The control of claim 13 wherein the means for sensing temperature include temperature sensors disposed on the refrigerant circuit inlet and outlet of the indoor and the outdoor heat exchange coils and on the suction line and discharge line sections of the first frigerant flow line.

* * * * *